US007921871B2

(12) United States Patent
Lawrence

(10) Patent No.: US 7,921,871 B2
(45) Date of Patent: Apr. 12, 2011

(54) LOW-PROFILE, LESS CONSPICUOUS RETRACTABLE GARDEN HOSE REEL

(76) Inventor: John E. Lawrence, Ypsilanti, MI (US)

( * ) Notice: Subject to any disclaimer, the term of this patent is extended or adjusted under 35 U.S.C. 154(b) by 246 days.

(21) Appl. No.: 11/855,515

(22) Filed: Sep. 14, 2007

(65) Prior Publication Data

US 2009/0071546 A1 Mar. 19, 2009

(51) Int. Cl.
*B65H 75/34* (2006.01)

(52) U.S. Cl. ..... 137/355.23; 137/355.16; 137/355.2

(58) Field of Classification Search ..... 137/343, 137/355.16, 355.2, 355.23
See application file for complete search history.

(56) References Cited

U.S. PATENT DOCUMENTS

| | | | | | |
|---|---|---|---|---|---|
| 2,478,540 | A * | 8/1949 | Martin | 137/355.2 |
| 3,217,738 | A * | 11/1965 | Springsteed | 137/355.2 |
| 3,776,262 | A | 12/1973 | Fritsch | |
| 4,543,982 | A * | 10/1985 | Wolfe | 137/355.21 |
| 5,526,842 | A * | 6/1996 | Christensen | 137/360 |
| 5,678,596 | A * | 10/1997 | Corallo | 137/357 |
| 6,467,499 | B1 | 10/2002 | Smith | |
| D472,133 | S | 3/2003 | Ball | |
| 6,672,329 | B1 | 1/2004 | Brooks et al. | |
| 6,834,813 | B1 | 12/2004 | Nobi | |
| 2004/0231723 | A1 * | 11/2004 | Harrington et al. | 137/355.2 |
| 2005/0178440 | A1 * | 8/2005 | Huang | 137/355.16 |
| 2006/0016480 | A1 * | 1/2006 | Cheng | 137/355.16 |

* cited by examiner

*Primary Examiner* — Stephen M Hepperle
*Assistant Examiner* — Kevin Murphy
(74) *Attorney, Agent, or Firm* — Gifford, Krass, Sprinkle, Anderson & Citkowski, P.C.

(57) ABSTRACT

Low-profile garden hose storage apparatus comprises a housing adapted for mounting onto an exterior wall of a building to store a garden hose having first and second ends and an outer diameter 'd'. A reel, rotatable in the housing, has a central hub and a pair of plates spaced apart at a distance of 1, 2 or 3*d*. In the preferred embodiment the plates are spaced apart at a distance slightly greater than d such that a single layer of hose may be wound thereon in a 'pancake' configuration. A water inlet is coupled to the hub through a swivel fitting, enabling the reel to rotate as water is delivered. The first end of the garden hose is coupled to the hub of the reel between the plates, with the second end of the garden hose extending through an opening in the housing. The apparatus further includes a mechanism for automatically winding the garden hose onto the reel between the plates, thereby retracting the hose into the housing through the opening thereof. The outer surface of the housing may be configured to be less conspicuous. For example, the outer surface of the housing may be configured to appear as house siding, brick or cinder block.

19 Claims, 4 Drawing Sheets

LOW-PROFILE, LESS CONSPICUOUS RETRACTABLE GARDEN HOSE REEL

FIELD OF THE INVENTION

This invention relates generally to garden hose reels and, in particular, to a garden hose reel which is retractable, low in profile, and less conspicuous.

BACKGROUND OF THE INVENTION

There are many garden hose enclosures, some of which are the subject of issued U.S. Patents. For example, U.S. Pat. No. 3,776,262 discloses a generally cylindrical garden hose enclosure carried on an annular base which encircles a sill cock when detachably mounted on the exterior wall of a house. The enclosure cover is cylindrical near the base, and truncated conical at the front, where it terminates in a dispensing opening. The hose is coiled around the inside of the cylindrical chamber, rather than being tightly wrapped around a core, and therefore does not kink and it is hidden from view by the truncated conical part of the cover.

In U.S. Pat. No. 5,678,596, a retractable garden hose apparatus comprises a reel assembly mounted to a ceiling joist within a basement adjacent an exterior wall of a building. A facility is for fluidly coupling a first end of a garden hose in the reel assembly, when the garden hose is wrapped within the reel assembly. A funnel shaped sleeve is connected between the reel assembly and an aperture in the exterior wall of the building, so that the funnel shaped sleeve will guide the garden hose through the aperture in the exterior wall of the building. An outdoor enclosure is mounted to the exterior wall of the building at the aperture. The enclosure has a rear opening in alignment with the aperture in the exterior wall, so that a second free end of the garden hose extending therethrough will be covered by the enclosure. A structure fits through the rear opening in the enclosure and the aperture in the exterior wall of the building, for sealing the rear opening (32) about the garden hose, to prevent the entrance of leaves, soil and air.

While the apparatus just described relies upon a spring-loaded retraction mechanism, motorized units exist. U.S. Pat. No. 6,672,329 teaches an in-wall retractable water hose assembly for retracting and storing a water hose, having a housing located within a dwelling and an insulated front access door for providing access to the hose from outside the dwelling. A reel assembly is mounted within the housing on which the water hose is spooled, and a motor connected to the reel assembly effects rotation of the reel. A power box is positioned within the housing and has a power switch in communication with the motor. A movable casing is mounted on the reel assembly, the casing having a channel for accommodating the water hose. Movement of the casing along the reel assembly determines the positioning of the hose and maintains an even distribution of the hose along the reel. A stabilizing bar prevents wobbling of the casing during retraction of the water hose.

Crank mechanisms have also been used for hose retraction purposes. Products from Yardic, for example (www2.yardic.com) show various crank-retracted hose reel, some of which are wall-mounted. Decorative hose covers also exist. In U.S. Pat. No. 6,467,499, a reel and hose-covering device includes a cover member dimensioned for receiving a reel and hose interiorly thereof. The cover member has a generally cylindrical configuration defined by a substantially closed front wall, an open back, and a cylindrical side wall therebetween. The cylindrical side wall is couplable with a selected wall area adjacent to the reel by a piano hinge whereby the cover member can be closed with the reel received within the open back. The cylindrical side wall has a metal strip secured thereto diametrically opposed from the piano hinge. The front wall has an opening therethrough to allow passage of the hose therethrough. A magnet is secured to the selected wall area adjacent to the reel opposed from the piano hinge. The magnet engages the metal strip of the cover member in a closed orientation.

Despite the article just described, the need nevertheless remains for a low-profile, wall-mounted, less conspicuous retractable garden hose reel.

SUMMARY OF THE INVENTION

This invention resides in low-profile garden hose storage apparatus. The apparatus comprises a housing adapted for mounting onto an exterior wall of a building to store a garden hose having first and second ends and an outer diameter 'd'. A reel, rotatable in the housing, has a central hub and a pair of plates spaced apart at a distance of 1, 2 or 3d. In the preferred embodiment the plates are spaced apart at a distance slightly greater than d such that a single layer of hose may be wound thereon in a 'pancake' configuration.

A water inlet is coupled to the hub through a swivel fitting, enabling the reel to rotate as water is delivered. The first end of the garden hose is coupled to the hub of the reel between the plates, with the second end of the garden hose extending through an opening in the housing. The apparatus further includes a mechanism for automatically winding the garden hose onto the reel between the plates, thereby retracting the hose into the housing through the opening thereof.

The mechanism for automatically winding the garden hose onto the reel may be an electric motor, a manually operated crank coupled to the hub of the reel through the housing, or a spiral return spring coupled to the hub of the reel. If an electric motor is used, it may operate bi-directionally, enabling the hose to be expelled from the housing as well as retracted. User controls may be provided on the outer surface of the housing, and the motor may be battery operated or wiring may be provided through the wall of the building upon which the housing is mounted.

The outer surface of the housing may be configured to be less conspicuous. For example, the outer surface of the housing may be configured to appear as house siding, brick or cinder block. Alternatively the housing has an outer surface configured to receive siding or brick facing. A length of hose may be provided having a first end forming the water inlet and a second end configured for attachment to a garden hose faucet. Alternatively length of hose or pipe may be provided having a first end forming the water inlet and a second end configured for attachment to a source of water through the building wall, particularly if the invention is provided in new construction.

DETAILED DESCRIPTION OF THE INVENTION

Figure 1:
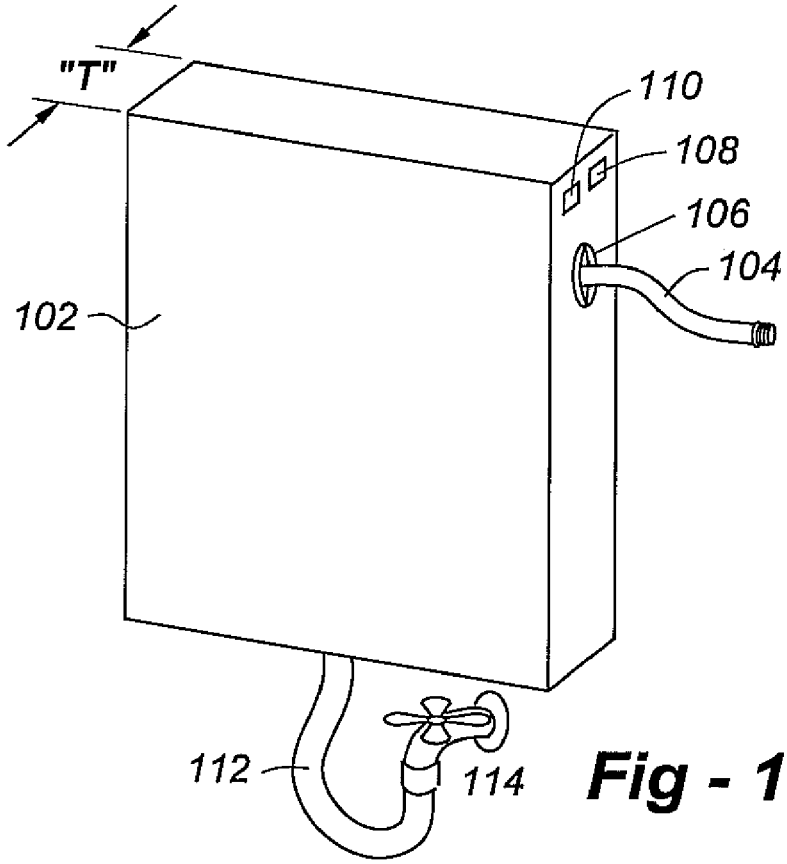
FIG. 1 is an oblique, simplified view of a preferred embodiment of the invention.
Figure 2:
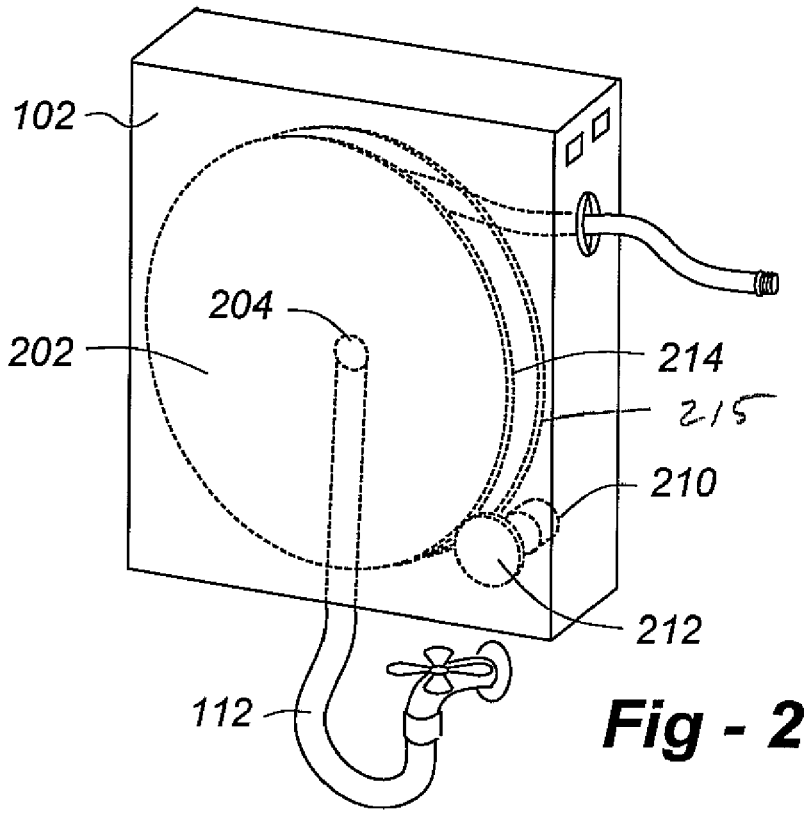
FIG. 2 shows parts of the interior of the embodiment shown in FIG. 1.

Turning now to the drawings, FIG. 1 is an oblique or a perspective view of the preferred embodiment of the invention. The apparatus includes a cover, 102 which may assume different forms as described herein, having a thickness "T" of just a few inches, in contrast to existing designs.

In the embodiment of FIG. 1, the hose 104, which extends through a flap 106, is extended and retracted utilizing controls 108, 110. These controls are interconnected to an electric motor 212, which may either be battery operated or, preferably, connected home wiring by way of a through-the-wall interconnect (not shown). Continuing the reference to FIG. 1, inlet water flows through hose 112, by way of faucet 114.

As shown in FIG. 27, the hose 104 is contained on a reel having plates 214, 215, which are spaced apart by a distance slightly larger than the diameter of a common garden hose. Thus, plates 214, 215 may be spaced apart by a distance of 1 to 1½ inches, or thereabouts. In the preferred embodiment, the hose 104 is wound onto the reel with only a single thickness of hose, thereby resulting in an extremely low-profile design. In an alternative embodiment, the plates 214, 215 may be spaced apart to hold two or three layers of hose thickness, but no more than that.

In the motorized embodiments of the invention, motor 210 includes a wheel 212 with teeth that engage with teeth on one of the plates 214, 215. Alternatively, a frictional interface between the drive 212 and plate 214 may be used. Belts/pulleys are also possible. Preferably, however, the motor is geared down through the use of a small reel 212 interfaced to a larger-diameter plate 214, thereby resulting in a small but powerful retraction capability. While, in the motorized embodiments, the motor may be used in reverse direction to extend the hose, to save on power, particularly when batteries are used, the hose may be manually pulled from the housing, but with a motorized retraction being used.

As mentioned, water is supplied through hose 112, which extends to a swivel coupling 204 behind the reel made up of plates 214, 215. Such swiveling-ups are well known in the art.

Figure 3:
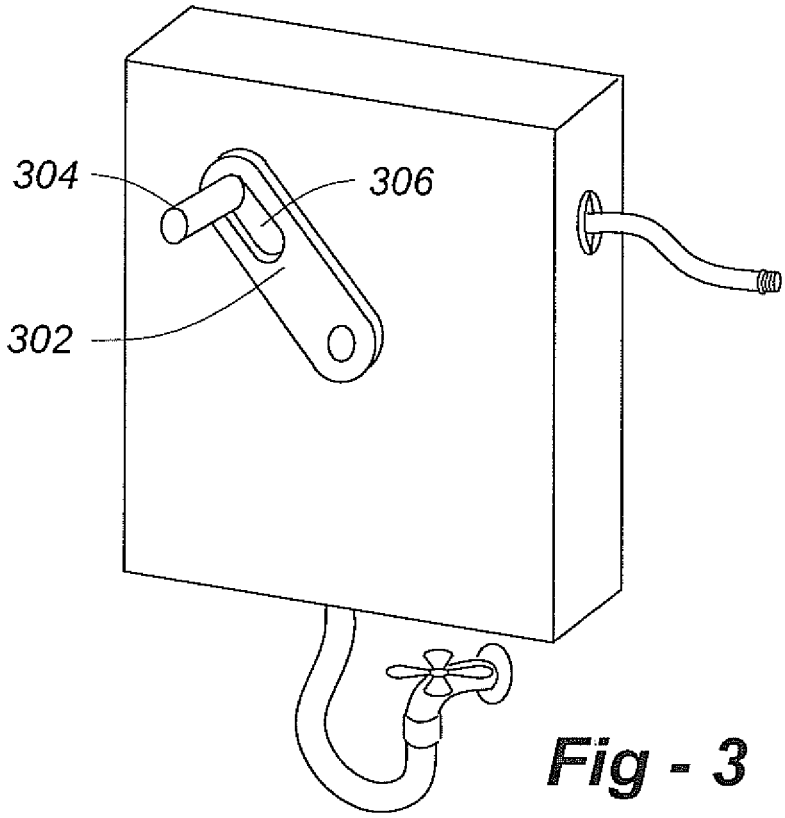
FIG. 3 is an oblique representation of a crank-operated embodiment of the invention.

FIG. 3 is a drawing which shows an alternative embodiment of the invention, wherein a crank handle 302 is used to extend and retract the hose. In this case, the handle 302 would have a direct, mechanical connection to the reel internal to the housing. The handle portion 304 may optionally fold down into a slot 306 during periods of non-use, to maintain the lowest possible profile.

Figure 4:
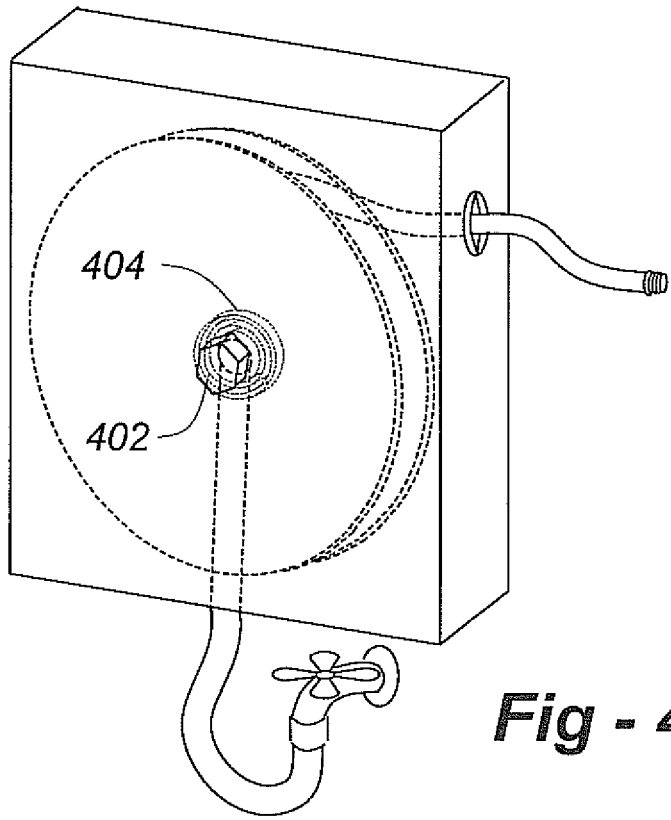
FIG. 4 is a drawing which shows a spin-biased retraction mechanism and tightening nut.

In FIG. 4, a spring-biased version of the invention is shown, which may use the type of mechanism disclosed in U.S. Pat. No. 5,678,596, the entire content of which is incorporated herein by reference. In this embodiment, a length of hose would be pulled from the housing, with a ratchet mechanism keeping it from being pulled back into the housing until a second tug on the hose is made, such retraction mechanisms are well known to those of skill in the art. In this embodiment, a bolt, such as 402, is connected to the spring 404 biasing the hose reel, to tighten it up as the spring fatigues, thereby maintaining a full retraction.

Figure 5:
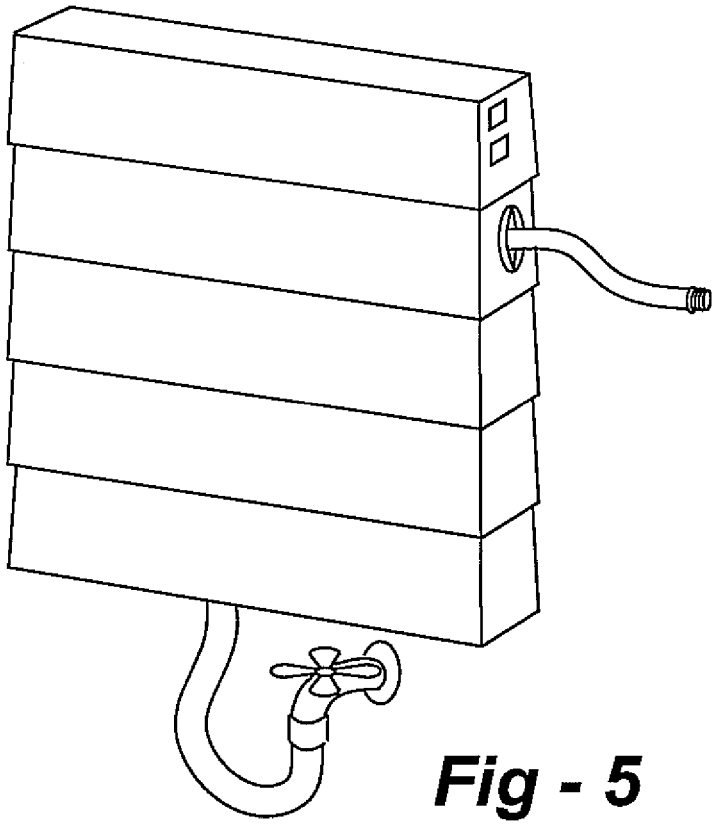
FIG. 5 is a drawing which shows how the covering for the hose reel, according to this invention, may assume the look of common house siding.
Figure 6:
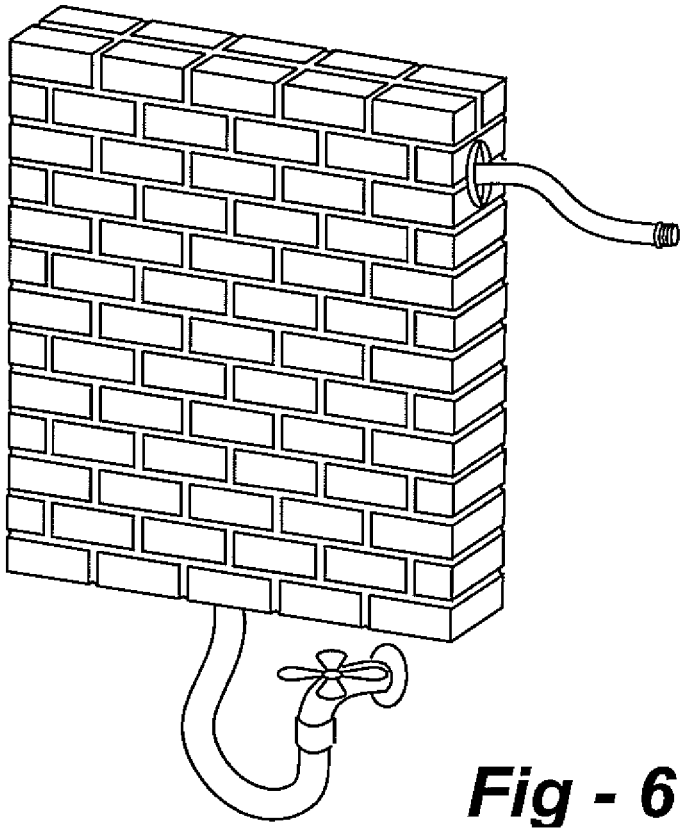
FIG. 6 depicts a brick-looking façade.
Figure 7:
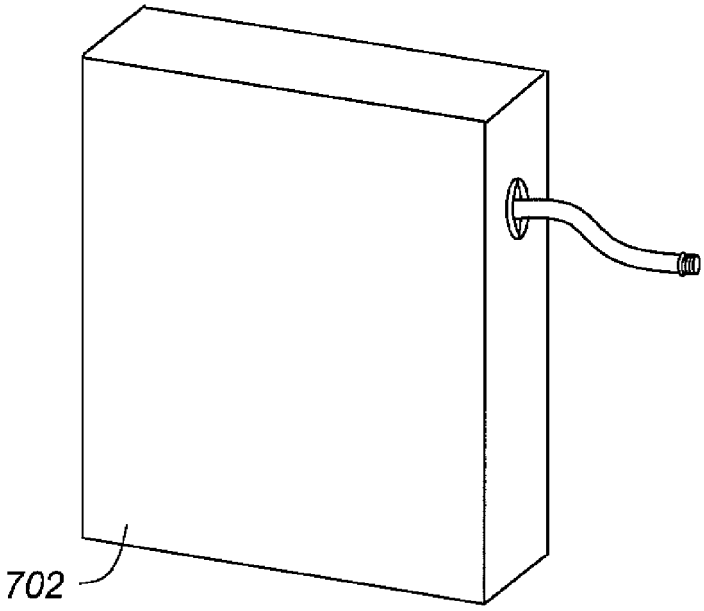
FIG. 7 is an oblique view of an alternative embodiment of the invention wherein both water and electrical connections are made to the wall.

FIG. 5 shows how the housing according to the invention may include siding to render the apparatus less conspicuous. Any width of siding may be used, and it may come in colors or, more preferably, may be paintable to the same color of the home upon which the apparatus is mounted. FIG. 6 shows how a brick façade may be used. Again, a plastic facing may be molded onto the housing, which may be painted to look like the brick of the home on which it is mounted. FIG. 7 is a drawing which shows a more plain housing 702, which may be painted to match the house color or which may be made of wood or other materials to accept siding or brick facing directly onto the surface.

Figure 8:
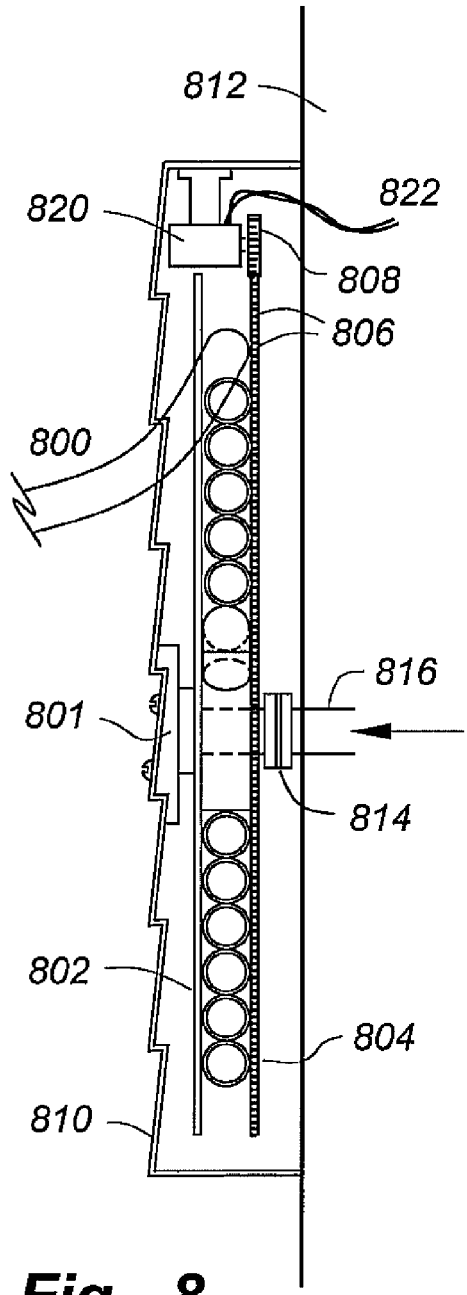
FIG. 8 is a cross-sectional view of the embodiment of FIG. 7, showing internal components.

FIG. 8 is a cross-sectional view of yet a further alternative embodiment of the invention, wherein both electrical wiring and water input are directed through a wall 812. The housing is shown at 810, and the house 800 shown between retainer flights 802, 804. A motor 820, driven through power wiring 822 turns a wheel 806 having teeth which engage with teeth on reel plate 804. The teeth are depicted at 806. The water inlet 816 travels through a swivel coupling 814, then goes into the interior of the reel, where it exits through port 817 connected to a hose 800. The mounting bracket 801 is used to hold the reel in rotatable position within the housing. Although this cross-section shows a siding-style appearance, any of the other appearances disclosed herein may alternatively be used.

In terms of materials, the covering for the reel mechanism is preferably molded plastic, though as described with reference to the embodiment of FIG. 7, wood or other materials may be used to receive siding or façade material separately. The reel plates 804 may be made out of plastic, whereas the brackets, and so forth, may be use a strong material such as metal.

I claim:

1. Low-profile garden hose storage apparatus, comprising:

a housing mounted onto an outside surface of an exterior wall of a building;

a water-carrying garden hose having first and second ends and an outer diameter 'd';

the second end of the garden hose including a threaded connector;

a reel rotatable in tile housing about an axis perpendicular to the wall, the reel having a central hub and a pair of plates spaced apart at a distance of 1, 2 or 3d;

the reel, hub and plates being disposed entirely within the housing and outside the outside surface of the wall;

a water inlet coupled to the hub through a swivel fitting enabling the reel to rotate as water is delivered;

the first end of the garden hose being coupled to the hub of the reel between the plates, the second end of the garden hose extending through an opening in the housing; and a mechanism for automatically winding the garden hose onto the reel between the plates, thereby retracting the hose into the housing through the opening thereof.

2. The garden hose storage apparatus of claim 1, wherein the mechanism for automatically winding the garden hose onto the reel is an electric motor.

3. The garden hose storage apparatus of claim 1, wherein:

the mechanism for automatically winding the garden hose onto the reel is an electric motor; and the motor operates bidirectionally, enabling the hose to be expelled from the housing as well as retracted.

4. The garden hose storage apparatus of claim 1, wherein:

the mechanism for automatically winding the garden hose onto the reel is an electric motor; and further including user controls for the motor disposed on the housing.

5. The garden hose storage apparatus of claim 1, wherein the mechanism for automatically winding the garden hose onto the reel is a manually operated crank coupled to the hub of the reel through the housing.

6. The garden hose storage apparatus of claim 1, wherein the mechanism for automatically winding the garden hose onto the reel is a spiral return spring coupled to the hub of the reel.

7. The garden hose storage apparatus of claim 1, wherein:

the mechanism for automatically winding the garden hose onto the reel is a spiral return spring coupled to the hub of the reel; and further including a mechanism for tightening the spring to increase the force of retraction.

8. The garden hose storage apparatus of claim 1, wherein the housing has an outer surface configured to appear as house siding.

9. The garden hose storage apparatus of claim 1, wherein the housing has an outer surface configured to appear as brick or cinder block.

10. The garden hose storage apparatus of claim 1, wherein the housing has an outer surface configured to receive siding.

11. The garden hose storage apparatus of claim 1, wherein the housing has an outer surface configured to receive brick facing.

12. The garden hose storage apparatus of claim 1, further including a length of hose having a first end forming the water inlet and a second end configured for attachment to a garden hose faucet.

13. The garden hose storage apparatus of claim 1, further including a length of hose having a first end forming the water inlet and a second end configured for attachment to a source of water through the building wall.

14. Low-profile garden hose storage apparatus, comprising:

a housing mounted onto an outside surface of an exterior wall of a building;

a garden hose having first and second ends and an outer diameter 'd';

a reel rotatable in the housing about an axis perpendicular to the wall, the reel having a central hub and a pair of plates spaced apart at a distance of slightly greater than 'd';

the reel, hub and plates being disposed entirely within the housing and outside the outside surface of the wall;

a length of hose having a first end coupled to the hub through a swivel fitting enabling the reel to rotate as water is delivered, and a second end extending through the housing for attachment to a garden hose faucet;

the first end of the garden hose being coupled to the hub of the reel between the plates, the second end of the garden hose extending through an opening in the housing; and a mechanism for automatically winding the garden hose onto the reel between the plates, thereby retracting the hose into the housing through the opening thereof.

15. The garden hose storage apparatus of claim 14, wherein the mechanism for automatically winding the garden hose onto the reel is an electric motor.

16. The garden hose storage apparatus of claim 14, wherein the mechanism for automatically winding the garden hose onto the reel is a manually operated crank coupled to the hub of the reel through the housing.

17. The garden hose storage apparatus of claim 14, wherein the mechanism for automatically winding the garden hose onto the reel is a spiral return spring coupled to the hub of the reel.

18. The garden hose storage apparatus of claim 14, wherein the housing has an outer surface configured to appear as house siding.

19. The garden hose storage apparatus of claim 14, wherein the housing has an outer surface configured to appear as brick or cinder block.

* * * * *